US010240306B2

(12) United States Patent
Lorenz

(10) Patent No.: US 10,240,306 B2
(45) Date of Patent: Mar. 26, 2019

(54) METHOD AND APPARATUS FOR CUTTING NON-LINEAR TRENCHES IN CONCRETE

(71) Applicant: Alexander Lorenz, Wyckoff, NJ (US)

(72) Inventor: Alexander Lorenz, Wyckoff, NJ (US)

(73) Assignee: Alexander Lorenz, Wycoff, NJ (US)

( * ) Notice: Subject to any disclaimer, the term of this patent is extended or adjusted under 35 U.S.C. 154(b) by 0 days.

(21) Appl. No.: 15/881,303

(22) Filed: Jan. 26, 2018

(65) Prior Publication Data

US 2018/0216301 A1 Aug. 2, 2018

Related U.S. Application Data

(60) Provisional application No. 62/499,484, filed on Jan. 27, 2017, provisional application No. 62/600,566, filed on Feb. 24, 2017.

(51) Int. Cl.

| | |
|---|---|
| ***E01C 23/00*** | (2006.01) |
| ***E01C 23/088*** | (2006.01) |
| ***B28D 1/24*** | (2006.01) |
| ***E04F 21/00*** | (2006.01) |
| ***B24B 7/18*** | (2006.01) |
| ***E01C 23/09*** | (2006.01) |
| ***B24B 23/00*** | (2006.01) |
| ***B28D 1/04*** | (2006.01) |
| ***B28D 1/30*** | (2006.01) |

(52) U.S. Cl.

CPC ..... *E01C 23/088* (2013.01); *B24B 7/186* (2013.01); *B24B 23/005* (2013.01); *B28D 1/045* (2013.01); *B28D 1/24* (2013.01); *B28D 1/30* (2013.01); *E01C 23/096* (2013.01); *E04F 21/00* (2013.01)

(58) Field of Classification Search

CPC ..... E01C 23/088; E01C 23/096; E04F 21/00; B24B 7/186; B24B 23/00; B28D 1/045; B28D 1/24; B28D 1/30

USPC ..... 404/72, 90, 94; 125/12

See application file for complete search history.

(56) References Cited

U.S. PATENT DOCUMENTS

| | | |
|---|---|---|
| 1,876,380 A | 9/1932 | Wittick |
| 2,736,311 A | 1/1952 | Coates |

(Continued)

FOREIGN PATENT DOCUMENTS

| | | |
|---|---|---|
| CN | 201671086 | 12/2010 |
| CN | 104697876 | 5/2017 |

(Continued)

*Primary Examiner* — Raymond W Addie

(74) *Attorney, Agent, or Firm* — Davis, Malm & D'Agostine, P.C.; Richard L. Sampson

(57) ABSTRACT

A walk-behind apparatus and method for cutting non-linear trenches in concrete includes a frame supported by fixed direction wheels at a front end on a fixed axis of rotation, and multi-directional wheels at a rear end to rotate on movable axes of rotation, to permit the frame to rotate about a vertical axis passing through the frame. A handle is engageable by a user walking behind the frame for pushing the apparatus forward and/or for steering. A cutting wheel has a diameter of 5-20 inches and a cutting portion having a width of 0.5-1.5 inches. The cutting rotates on an axis parallel to the fixed axis and which extends notionally through the fixed direction wheels. The cutting wheel is disposed within a protective shroud viewable by the user to permit the user to visually align and guide the cutting wheel along a non-linear path on the ground while steering.

26 Claims, 12 Drawing Sheets

(56) References Cited

U.S. PATENT DOCUMENTS

| | | | | |
|---|---|---|---|---|
| 3,747,981 | A | 7/1973 | Zuzelo | |
| 4,188,754 | A | 2/1980 | Yamamoto | |
| 4,998,775 | A | 3/1991 | Hollifield | |
| 5,176,426 | A | 1/1993 | Adamson | |
| 5,429,420 | A * | 7/1995 | Johnson | B23D 47/12 125/13.01 |
| 5,445,437 | A | 8/1995 | Adamson | |
| 6,131,557 | A | 10/2000 | Watson | |
| D434,782 | S | 12/2000 | Comas | |
| 7,273,048 | B1 | 9/2007 | Zuzelo | |
| 7,946,906 | B2 | 5/2011 | Gifford et al. | |
| 9,027,542 | B2 * | 5/2015 | Ronzello, Sr. | B28D 7/02 125/13.01 |
| 9,844,868 | B1 * | 12/2017 | Abbey | B25D 17/32 |
| 2005/0191133 | A1 * | 9/2005 | Purcell | G02B 6/504 405/157 |
| 2006/0053629 | A1 * | 3/2006 | Martin | B23D 59/006 30/123 |
| 2010/0043767 | A1 * | 2/2010 | Marsic | B23D 47/12 125/13.01 |
| 2010/0126327 | A1 * | 5/2010 | Cabral | B28D 1/048 83/835 |
| 2014/0270952 | A1 * | 9/2014 | Karsten | E01C 23/088 404/75 |
| 2015/0126096 | A1 | 5/2015 | Rizzo | |
| 2016/0332330 | A1 * | 11/2016 | Carlsson | B28D 1/045 |
| 2017/0274489 | A1 * | 9/2017 | Baratta | B23D 59/001 |

FOREIGN PATENT DOCUMENTS

| | | |
|---|---|---|
| DE | 199 31078 | 11/2001 |
| DE | 199 31078 A1 | 11/2001 |

* cited by examiner

LENGTH OF STRAIGHT CUT AS FUNCTION OF BLADE DIAMETER

METHOD AND APPARATUS FOR CUTTING NON-LINEAR TRENCHES IN CONCRETE

RELATED APPLICATION

This application claims the benefit of U.S. Provisional Patent Application Ser. No. 62/499,484, entitled MACHINE FOR GRINDING NON-LINEAR TRENCH INTO CONCRETE—501, filed on Jan. 27, 2017, and claims the benefit of U.S. Provisional Patent Application Ser. No. 62/600,566, entitled APPARATUS FOR CUTTING LINE PATTERNS INTO CONCRETE—EXTENDED, filed on Feb. 24, 2017, and the contents of which are incorporated herein by reference in their entirety for all purposes.

BACKGROUND

Technical Field

This invention relates to an apparatus and method for cutting non-linear trenches into concrete decks and floors in walk-behind fashion to make the resulting concrete resemble natural stone or flagstone pavers.

Background Information

Concrete is one of the most common building materials in the world. It is used for sidewalks, foundations, roads and numerous other applications. One common application of concrete is as a material for flooring, both indoors and outdoors, e.g., by pouring concrete into a preformed shape by use of forms fabricated from wood or other suitable materials. Over time, horizontal concrete surfaces (concrete ground surfaces), especially outdoors, suffer from deterioration due to aging, freeze-thaw cycles and other environmental factors. In particular, freeze-thaw cycles and the resultant thermal expansion/contraction create cracks in outdoor concrete surfaces such as sidewalks and roads, and cause it to crumble. Various approaches have been devised to repair these cracks in the hope of prolonging the useful life of these outdoor concrete surfaces. For example, cracks can be cleared of debris, e.g., using hand-held electric grinders and the like, and then filled with caulk or other flexible fillers. Such repairs, however, tend to be unsightly and the caulk tends to dry out and require periodic replacement.

Other attempts to prolong the life of outdoor concrete surfaces involve using conventional grinders to make linear cuts in the concrete to form joints that allow for expansion and that provide a controlled crack direction (following the joint which makes the concrete thinner along its length). However, conventional grinders used for this purpose, namely, for making fresh cuts in concrete without following pre-existing cracks, tend to be limited to cutting straight lines. Conventional handheld grinders also tend to be difficult to operate for extended periods of time, forcing the user to be hunched over in close proximity to the cutting wheel.

Moreover, the foregoing approaches produce surfaces with obviously repaired cracks and linear cuts of limited aesthetic appeal. Thus, a need exists for a system and method for restoring concrete surfaces that addresses the aforementioned issues.

SUMMARY

In an aspect of the present invention, a walk-behind apparatus for cutting non-linear trenches in concrete includes a frame supported by at least three ground engaging wheels, including one or more fixed direction wheels at a front end portion of the frame disposed to rotate on a fixed axis of rotation, and one or more multi-directional wheels at a rear end portion of the frame disposed to rotate on one or more movable axes of rotation, to permit the frame to rotate about a substantially vertical axis passing through the frame normal to the ground. A handle at the rear end portion of the frame is engageable by a user walking behind the frame for pushing the apparatus forward and/or for steering the apparatus by pushing the handle left or right. A motor-driven ground-engaging cutting wheel has a cutting wheel axis of rotation, a diameter D in a range of from about 5 inches to about 20 inches, and a cutting portion having a width w in a direction parallel to the cutting wheel axis of rotation within a range of from about 0.5 inches to about 1.5 inches. The cutting wheel axis of rotation is substantially parallel to the fixed axis of rotation and extends notionally through the fixed direction wheels.

The cutting wheel is disposed within a disc-shaped protective shroud sized and shaped to contain a majority of the cutting wheel therein during operation. The protective shroud is disposed in view of the user to permit the user to visually align the shroud and cutting wheel with a non-linear path on the ground while pushing and/or steering, to guide the cutting wheel along the non-linear path.

In particular embodiments, an additional aspect of the present invention includes the cutting wheel having circumferentially spaced metallic segments, the segments each having a cutting surface of convex cross-section in a plane parallel to the cutting wheel axis of rotation, so that during operation, the metallic segments are configured to cut a kerf in a concrete ground surface while the convex cross-section permits the cutting wheel to ride up and/or into side walls of the kerf while steering to avoid binding.

In another aspect of the invention, a method for restoring a concrete ground surface by forming portions resembling natural stone, pavers or flagstone, includes use of the apparatus of either of the foregoing aspects, in which a user engages the handle to steer the apparatus to a desired location on the concrete ground surface. While engaging the handle, the user visually aligns the shroud and cutting wheel with a non-linear path on the concrete ground surface, and actuates the cutting wheel to rotate about the cutting wheel axis of rotation. The cutting wheel is then engaged with the concrete ground surface to cut a kerf, while the user walks behind and steers the apparatus to guide the cutting wheel along the non-linear path.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
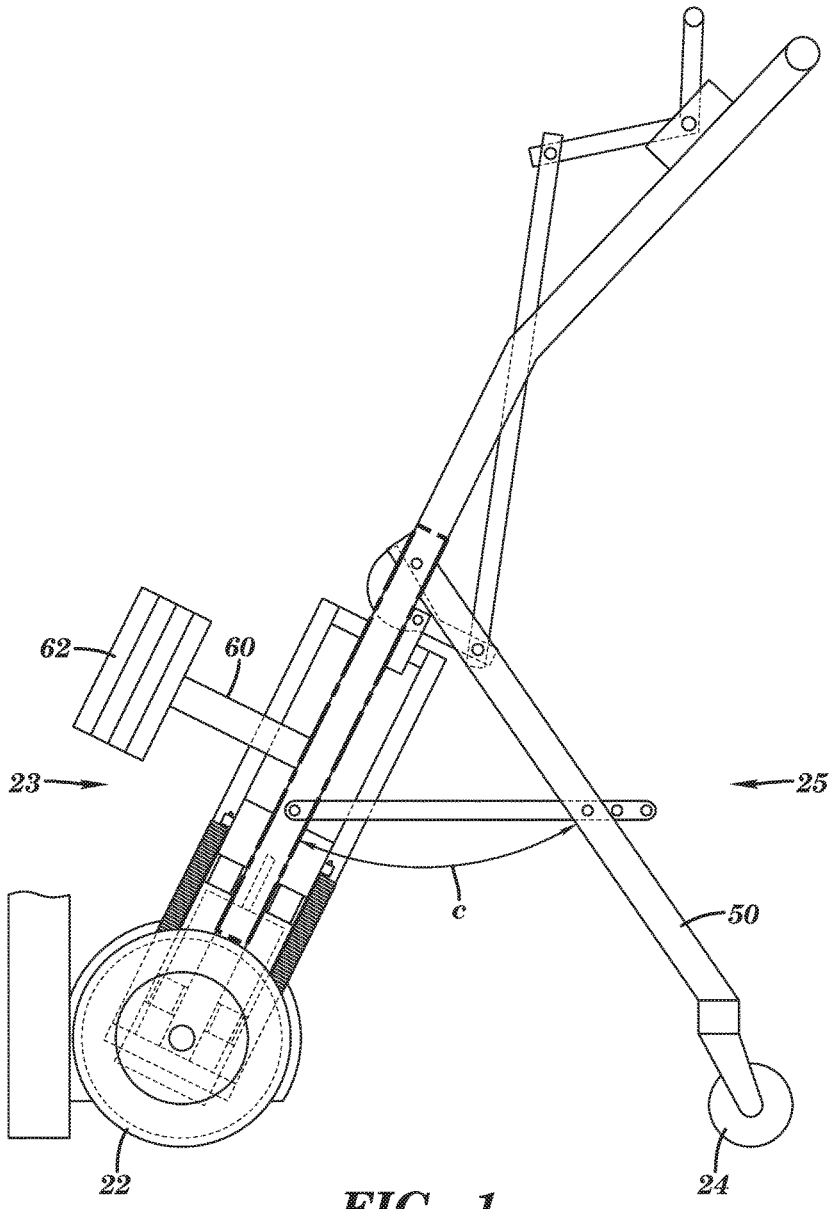
FIG. 1 is a left-hand elevational side view of an embodiment of the present invention.
Figure 2:
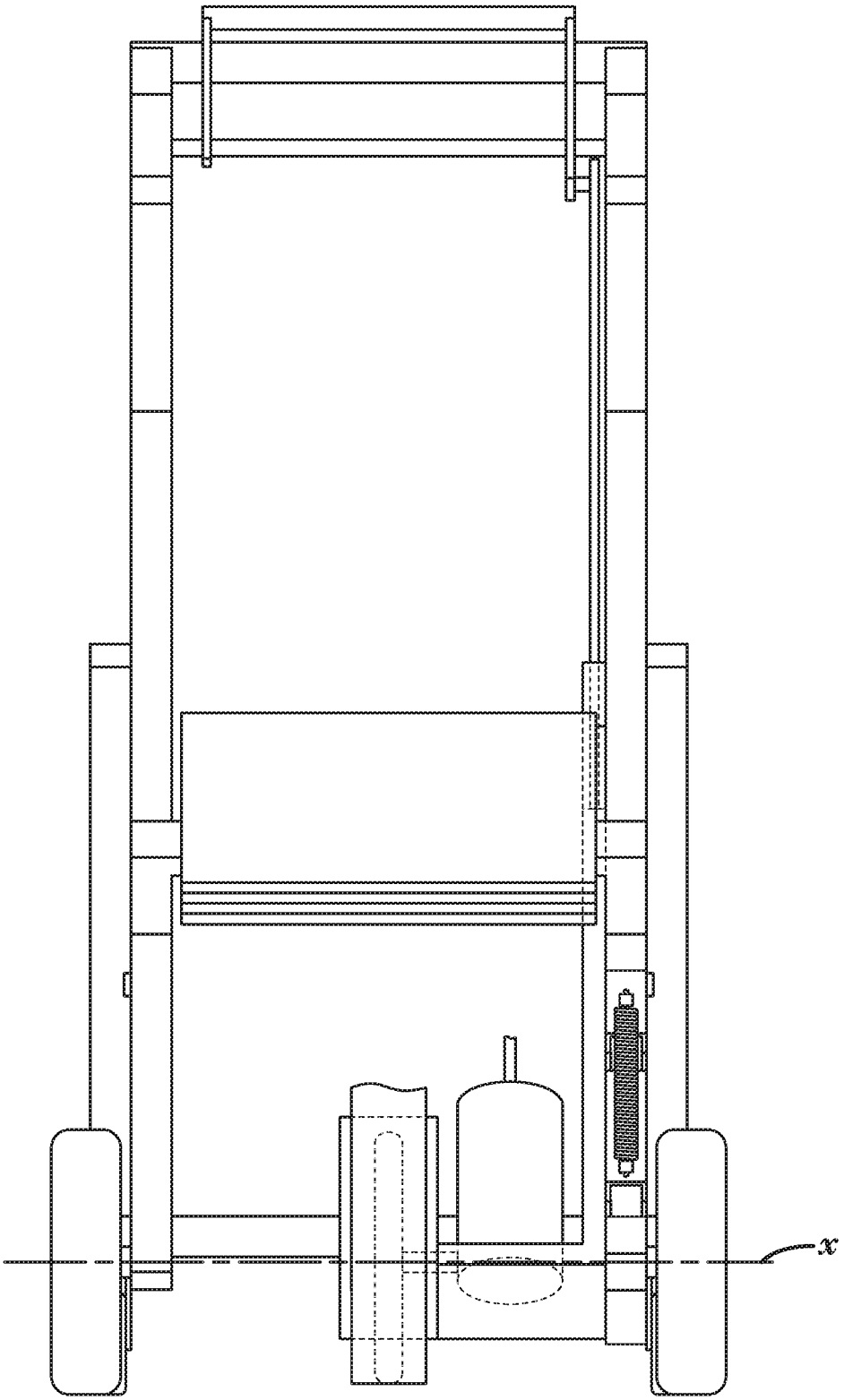
FIG. 2 is a front view of the embodiment of FIG. 1.
Figure 3:
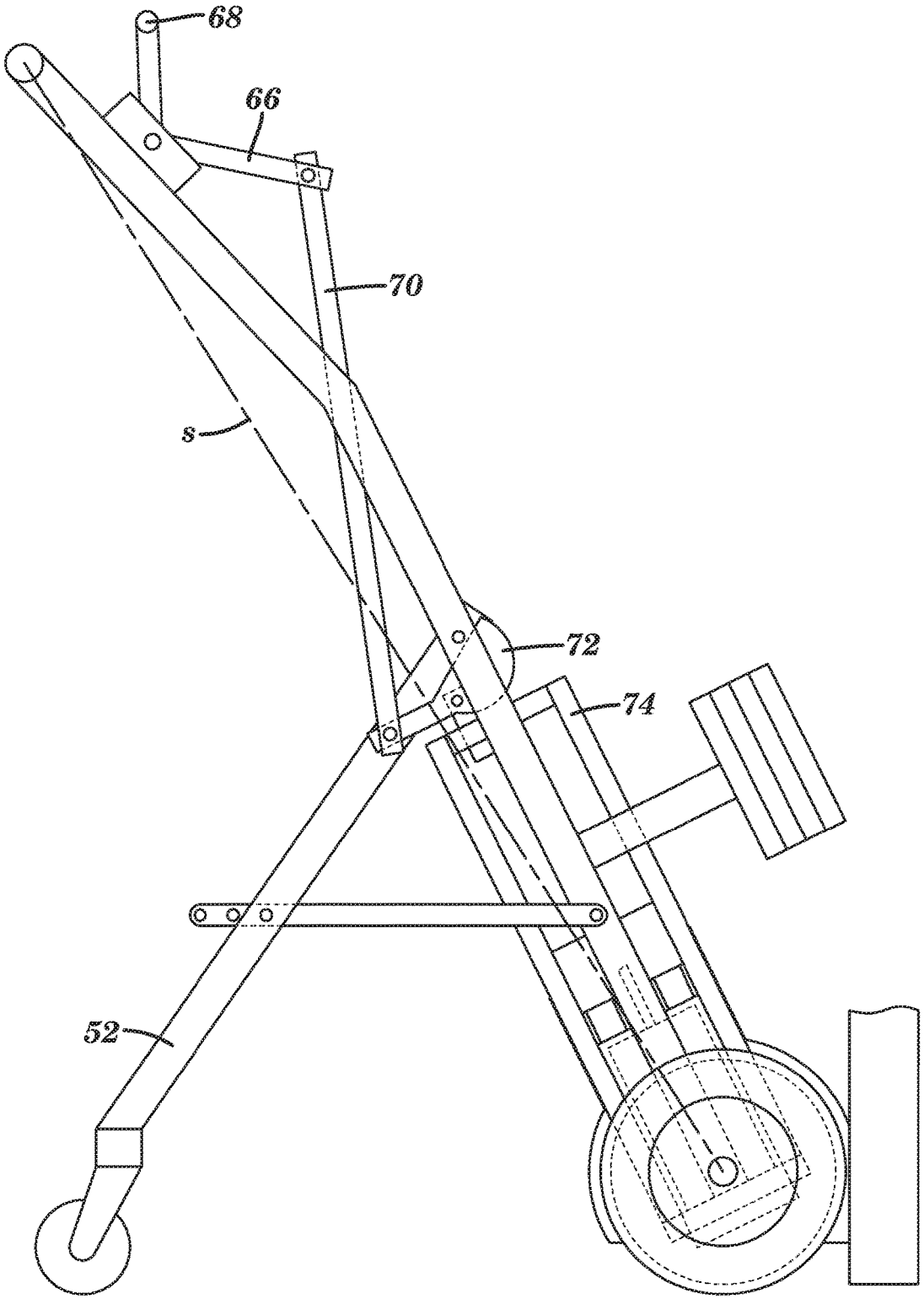
FIG. 3 is a right-hand elevational side view of the embodiment of FIGS. 1 and 2.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents.

Terminology

As used in the specification and in the appended claims, the singular forms "a", "an", and "the" include plural referents unless the context clearly indicates otherwise. Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

General Overview

In particular embodiments, a method and apparatus is provided for allowing an operator to cut non-linear trenches (kerfs) into concrete decks and floors in walk-behind fashion to make the resulting concrete resemble natural stone or flagstone pavers. In particular embodiments, the apparatus include a relatively large diameter segmented grinding wheel configured to produce kerfs of various depths with generally arcuate or concave cross section of various radii. These kerfs and the configuration of the apparatus serves to provide relatively low transverse forces on the grinding wheel to help prevent the wheel from binding in the kerf as the apparatus is steered to produce the non-linear cuts, while the grinding wheel is configured to accommodate remaining transverse forces. These aspects enable the grinding wheel to be relatively large diameter, for enhanced efficiency and relatively long useful life, while still being able to efficiently cut along non-linear paths. A handle-actuated depth gauge allows the operator to move the grinding wheel into and out of the concrete at various predetermined depths. Particular embodiments also include an integrated dust collector.

The present inventor has recognized that when concrete surface repair may be necessary or desirable for structural or aesthetic purposes, it may be desirable to do so in manner that changes the surface shape, and optionally color, to one that resembles natural stones or pavers. Since natural stone and pavers typically have irregular sizes and shapes with non-linear edges, it would be desirable to cut irregular and non-linear patterns into the surface of the concrete in order to achieve the desired resemblance. The inventor further recognized that prior to the invention there was no wheel-supported (walk-behind) or otherwise useful device available that would allow the operator to make these non-linear cuts in a consistent and operator-friendly manner.

For example, it was recognized that one type of commercially available device is a walk-behind floor cutting saw made for straight cuts, such as to cut contraction/control joints. These cuts are relatively deep and narrow requiring relatively large diameter, thin blades, e.g., ⅛" wide by 20" in diameter. One skilled in the art would recognize that deviations from a straight cut would tend to bind the blade against the walls of the kerf, potentially damaging and/or shattering the blade. Conventional hand-held floor cutting saws are similarly configured for straight cuts.

Conventional specialty saws may allow a user to follow pre-existing (e.g., non-linear) cracks. However, these saws are generally not adapted for cutting new non-linear trenches. It was further recognized that conventional hand-grinders would generally be incapable of providing desired levels of efficiency in a high volume and/or large scale application, as the operator would quickly tire of holding and operating the grinder.

The instant inventor recognized that in order to cut kerfs in concrete ground surfaces of consistent depth along non-linear paths, without binding and/or shattering the grinding wheel, at least two issues had to be overcome:

A. The tool should be maneuverable in a fashion that allows the cutting wheel to follow an irregular, non-linear path while reducing as much as possible, lateral forces on the wheel during a turn. In other words, transverse forces generated when the operator turns the wheel to the left or to the right to deviate from a straight path, would need to be minimized, since a wheel that is pushed transversely or at an angle to its plane of rotation tends to bind against the trench (kerf) subjecting it to damage.

B. Since some transverse forces must be expected in some applications when cutting non-linear kerfs, the wheel should be configured to accommodate some lateral forces without damage.

Figure 12:
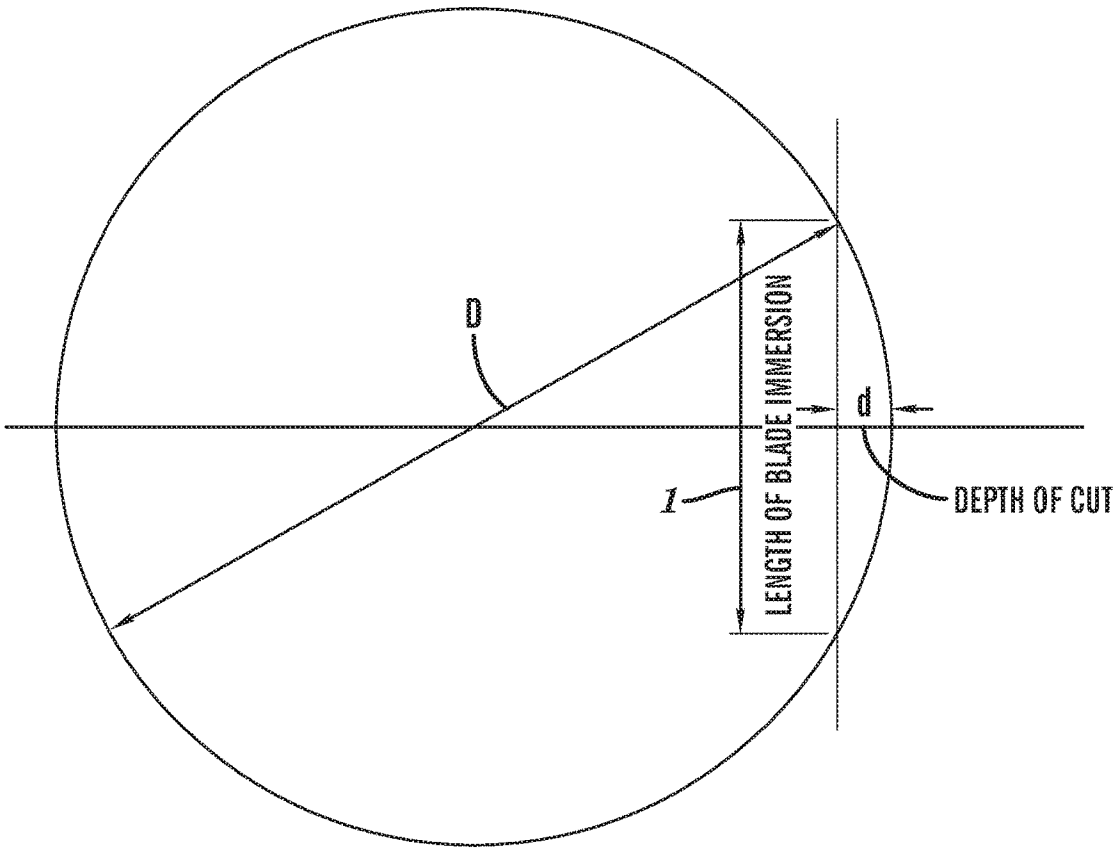
FIG. 12 is a graphical representation of the length of blade immersion in a kerf as function of blade diameter in accordance with embodiments of the present invention.
Figure 13:
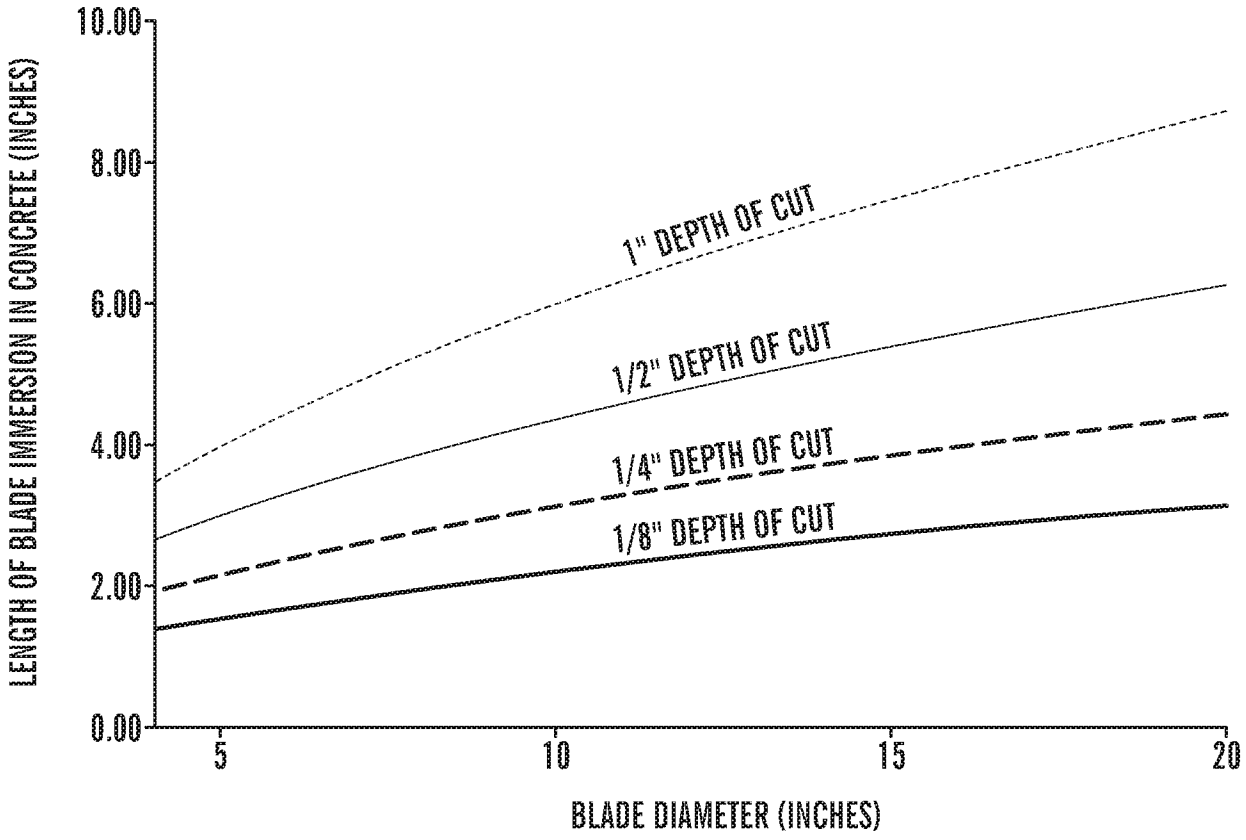
FIG. 13 is a graphical representation of length of blade immersion as a function of blade diameter at various depths of cut.
Figure 14:
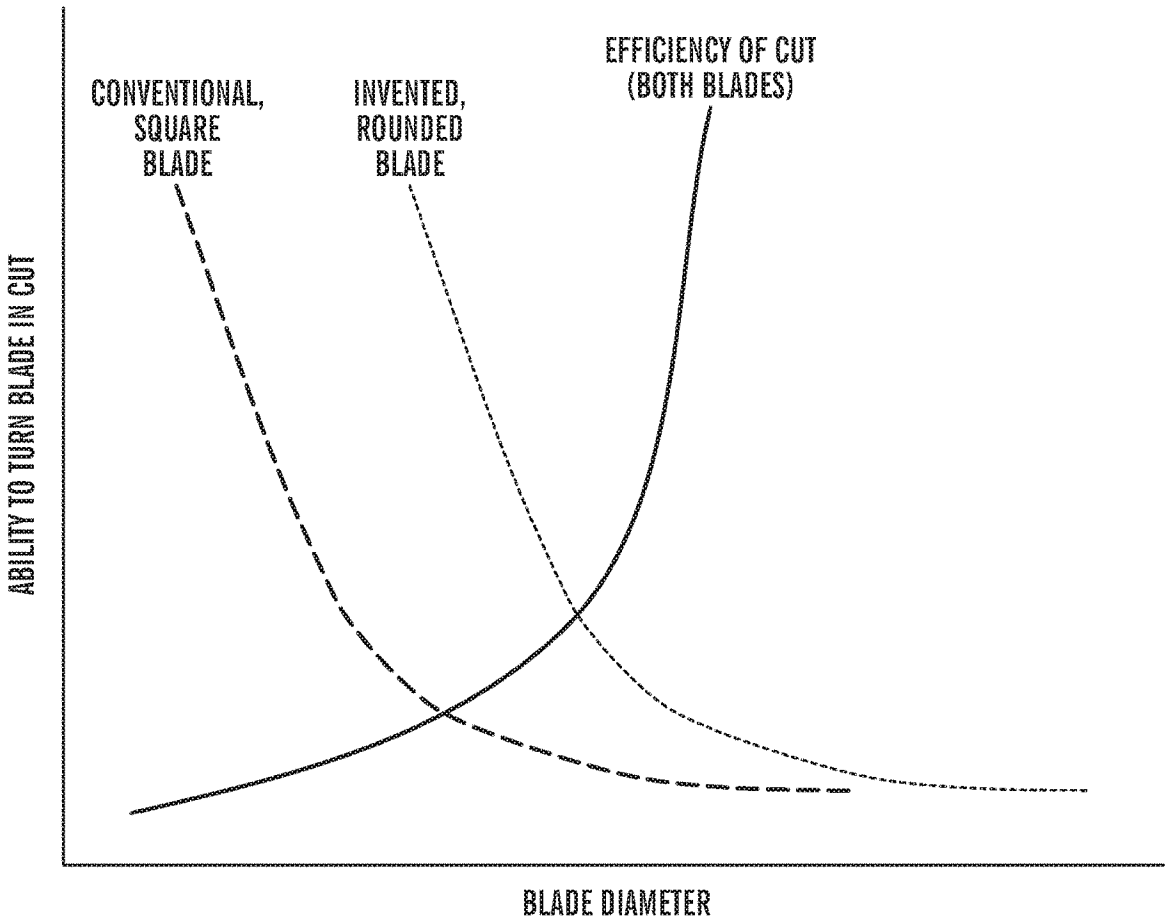
FIG. 14 is a graphical representation of relative ability to execute non-linear cuts as a function of blade diameter, for blades of convex and rectilinear cross-section.

Referring now to the Figures, embodiments of the present invention will be described in detail. Turning initially to FIGS. 12-14, the instant inventor has recognized that the diameter of the cutting (or grinding) blade is generally proportional to cutting efficiency, since a wheel with a larger diameter tends to have a longer useful life and tends to produce smoother and more uniformly smooth kerfs than a wheel of smaller diameter. Conversely, the inventor has also recognized that the diameter of the cutting wheel is inversely proportional to the ability to cut non-linear kerfs, because of the longer length of blade immersion of larger radius wheels.

In this regard, as shown in FIG. 12, the diameter D of a cutting wheel, used to cut a kerf of depth d, necessarily has a length of blade immersion 1. It can then be recognized that for a given depth d, the length of blade immersion 1 increases with the diameter D. So while a larger radius offers advantages in terms of wheel life, ease of use, and smoothness of the resulting kerfs, the longer length of blade immersion 1 tends to limit the ability to make non-linear kerfs due to a tendency of conventional cutting wheels to bind against the wall of the kerf when the user attempts to steer away from a straight (linear) cut, as will be discussed in greater detail hereinbelow. FIG. 13 is a graph showing the length of blade immersion 1 on the y-axis, as a function of blade diameter D on the x-axis, for a variety of cutting depths d.

In light of the foregoing, it will be recognized that an aspect of embodiments of the present invention is the provision of relatively large diameter cutting/grinding wheels that are capable of being steered during operation to produce non-linear kerfs. FIG. 14 is an illustration showing the relatively ability of both conventional cutting wheels and cutting wheels of the present invention, to product non-linear kerfs, as a function of wheel diameter d. The inventive embodiments thus provide the efficiency of a relatively large diameter cutting blade, along with the ability to turn that is generally associated with a relatively small diameter cutting blade. Particular embodiments accomplish this by providing relatively wide, and in many cases, radiused, cutting surfaces, as will be discussed hereinbelow with respect to FIGS. 6 and 7.

As shown in FIGS. 1-5, a walk-behind apparatus 10 for cutting non-linear trenches in concrete includes a frame 20 supported by at least three ground engaging wheels. In particular embodiments, frame 20 includes one or more (e.g., two as shown) fixed direction wheels 22. (FIGS. 2 and 5) at a front end portion 23 of the frame. Wheels 22 are disposed to rotate on a fixed (virtual) axis of rotation shown as axis x in FIGS. 2 and 5. One or more (e.g., two as shown) multi-directional wheels 24 (FIGS. 1 and 5) are disposed at a rear end portion 25 of the frame and are configured to rotate on movable axes of rotation. A handle 30, e.g., approximately 48 inches above the ground in particular embodiments, is disposed at the rear end of the frame 20 is engageable by a user walking behind the frame for pushing the apparatus forward and for steering the apparatus by pushing the handle left or right.

In particular embodiments, the frame 20 is foldable to facilitate storage and transportation, e.g., the frame includes articulating members configured to alternately move the rear end portion 25 away from the front end portion 23 into an operational position, and to move the rear end portion 25 toward the front end portion 23 into a closed, storage position. Referring to FIG. 1, in a particular exemplary embodiment, the articulating members include articulating legs 50 and 52, which pivot along the direction of arrow c between an open position as shown, to a closed position as shown in phantom. Moreover, as best shown in FIG. 5, in particular embodiments legs 50 and 52 are fastened to one another with a substantially horizontal crossbar 54 that supports wheels 24, to form a U-shaped sub-frame.

Figure 8:
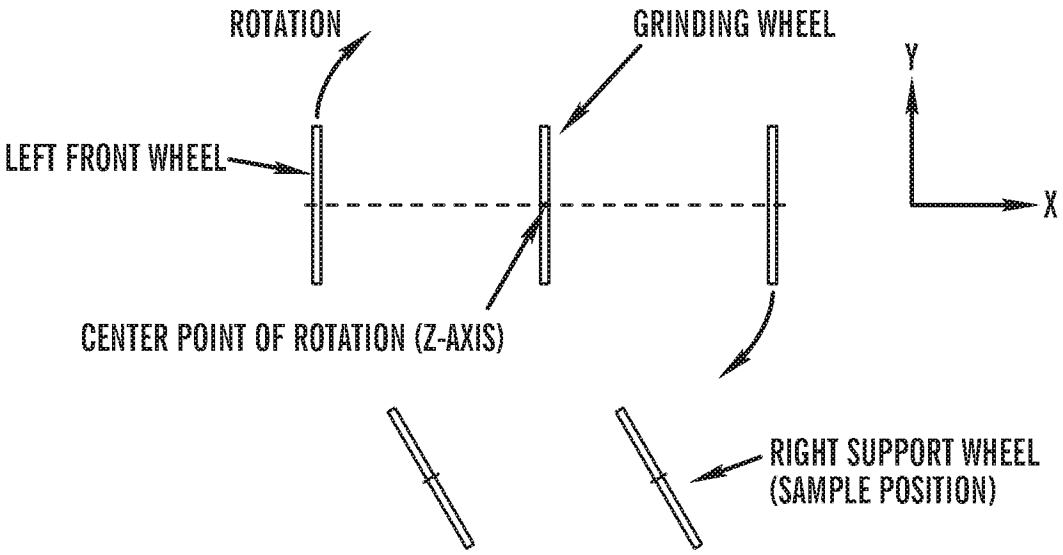
FIG. 8 is a schematic plan view of wheel positions of the embodiments of FIGS. 1-5 during operation.
Figure 11:
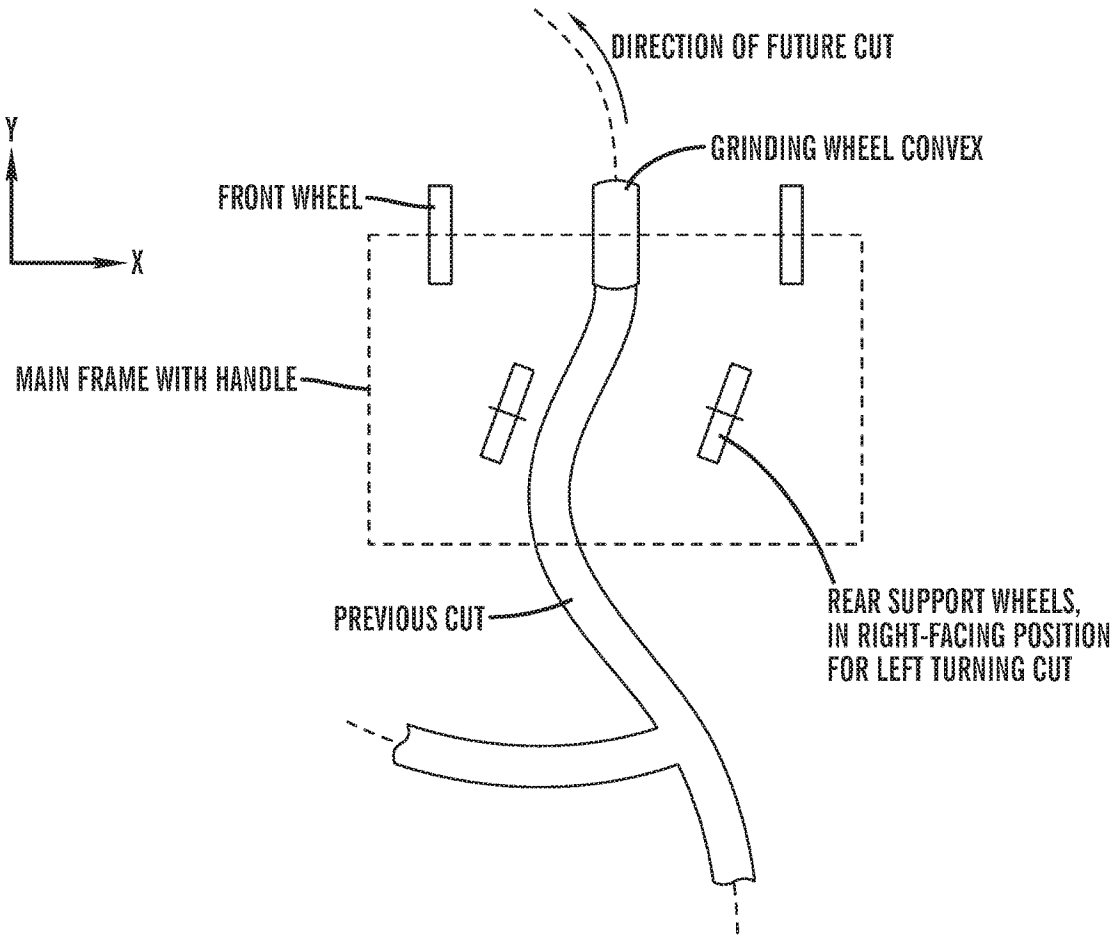
FIG. 11 is a view similar to that of FIG. 8, including a non-linear kerf produced by embodiments of the present invention.

In the embodiment shown, multi-directional wheels 24 are held by free spinning (swivel) castors that permit the wheels' axes of rotation to be rotated 360 degrees about a vertical (z) axis. As best shown in FIGS. 8 and 11, the ground engaging wheels 22 and 24 define an x-y plane (e.g., a substantially horizontal plane) extending along the concrete ground surface within which the kerf(s) is being cut, and permit the frame to rotate about a z-axis (e.g., vertical axis) passing through the frame normal to the x-y plane. For example, referring to FIG. 8, the apparatus 10 may be rotated in the clockwise (right hand) direction about a z-axis running through the center of a cutting wheel 26 by pushing the handle 30 to the left as shown at arrow a in FIG. 5. The user may push the handle 30 to the right to execute a counterclockwise (left hand) turn.

Figure 5:
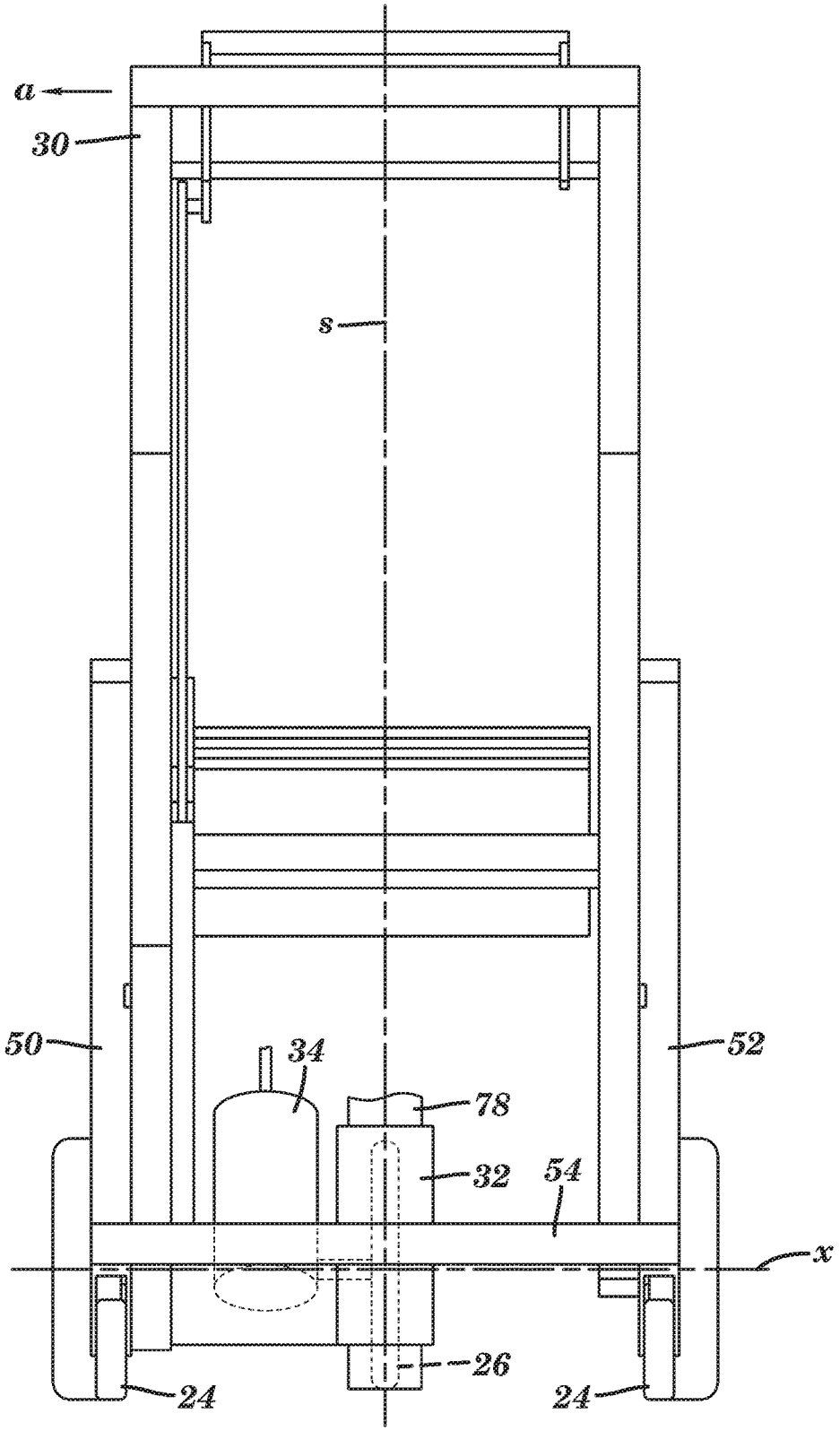
FIG. 5 is a rear view of the embodiments of FIGS. 1-4.
Figure 7:
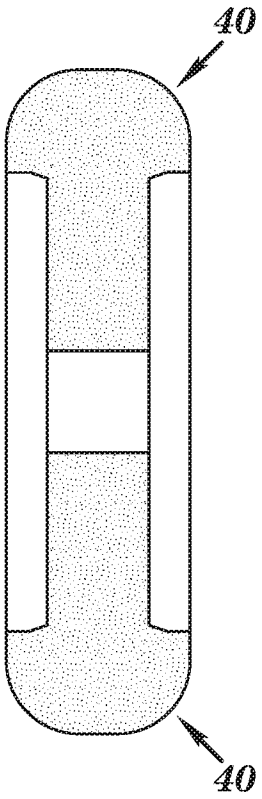
FIG. 7 is a cross-sectional view taken along 7-7 of FIG. 6.
Figure 6:
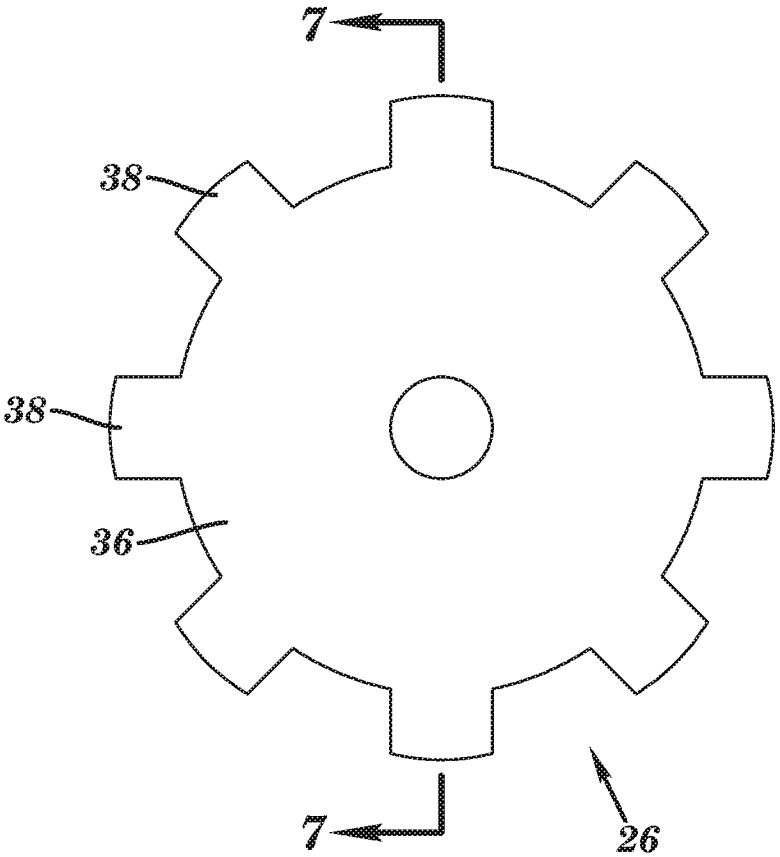
FIG. 6 is a schematic side view of a cutting wheel usable in the embodiment of FIGS. 1-5.

As best shown in FIGS. 5-7, cutting wheel 26 is disposed at the front end portion of the frame 20, with a cutting wheel axis of rotation that is substantially parallel to the fixed axis of rotation x of wheel(s) 22. In particular embodiments, the cutting wheel 26 is disposed so that it overlaps with wheel(s) 22 when viewed along the x-axis. In particular embodiments as shown, the overlap is such that the axis of rotation of wheel 26 extends notionally through wheel(s) 22. Moreover, in the particular embodiment shown, cutting wheel 26 is disposed substantially equidistantly between the pair of wheels 22 and is approximately the same diameter as wheels 22. The cutting wheel 26 may also be disposed within a substantially disc-shaped protective shroud 32 sized and shaped to contain a majority of the cutting wheel therein during concrete cutting operation.

As also shown in FIG. 5, cutting wheel 26 is driven by a motor 34 disposed in spaced relation from wheel 26 along the cutting wheel axis. This spaced orientation along with the open configuration of frame 20 provides a user walking behind the frame while engaging handle 30 with a clear line of sight s (FIGS. 3 and 5) extending from handle 30 through frame 20 to the shroud 32. The clear line of sight permits the user to visually align the shroud and cutting wheel with a non-linear path on the ground to guide the cutting wheel along the non-linear path by pushing and steering the frame.

Moreover, while motor 34 may take any of a number of conventional configurations, in particular embodiments, motor 34 may take the form of a conventional handheld grinder which is removeably supported by frame 20 as shown. In these embodiments, motor 34 and the cutting wheel 26 driven thereby form a substantially conventional unitary assembly that may be easily fastened to the frame for use as shown and described herein, while being easily removed therefrom to facilitate maintenance and/or replacement. For example, this unitary assembly may take the form of a commercially available handheld grinder of the type configured to use grinding wheels of approximately 7" diameter.

Referring now to FIGS. 6-7, in particular embodiments, cutting wheel 26 is a segmented grinding wheel having a metallic body 36 and a plurality of circumferentially spaced metallic segments 38. Metallic segments 38 each have a cutting surface of convex cross-section in a plane parallel to the cutting wheel axis of rotation, and which include a layer of abrasive grains 40 brazed, welded, or otherwise secured thereto in a conventional manner. The use of metallic segments 38, rather than conventional bonded abrasive grinding wheels made from a matrix of coarse abrasive particles pressed and bonded together, helps to maintain the desired curvature of the wheel (and the kerf) as discussed hereinbelow. In this regard, the instant inventor recognized that bonded abrasive wheels are highly sacrificial, with abrasive particles continually being worn off the surface of the wheel during operation. The inventor recognized that this sacrificial nature would quickly attenuate any cross-sectional curvature, making it difficult to maintain the desired concavity of the wheel/kerf as the wheel wears. On the other hand, the use of segments 38, including fabricating them from a mechanically tough metallic material with a brazed or welded cutting layer 40, permits the segments to maintain their convex geometry even after prolonged cutting operation. In various embodiments, wheel 36 has a diameter D in a range of from about 5 inches to 20 inches, with particular embodiments having a diameter D in a range of from about 6 inches to 8 inches, for cutting depths of in a range of from about 0.25 inches to 0.5 inches. In these embodiments, the width w of the cutting portion (segments) 38 is within a range of from about 0.5 inches to about 1.5 inches, with particular embodiments having a width w within a range of from about 0.75 inches to 1.25 inches.

Figure 9:
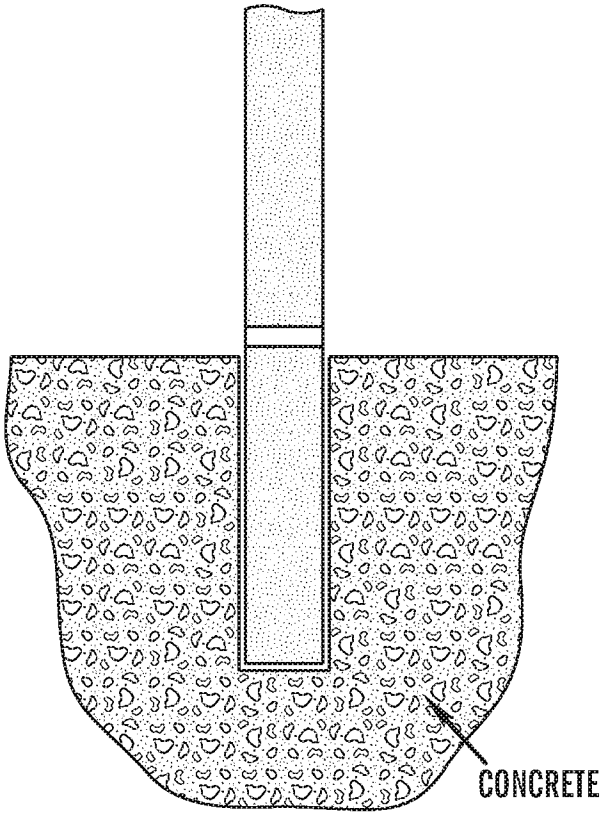
FIG. 9 (Prior Art)
FIG. 9 is a cross-sectional schematic view of a cutting wheel of the prior art during cutting operation.

Moreover, while particular embodiments include the aforementioned segmented grinding wheel, it should be recognized that cutting wheels of conventional rectilinear cross-section, such as shown in FIG. 9, having a diameter D and width w within the aforementioned ranges, may be used in some applications without departing from the scope of the present invention. For example, such a wheel may operate satisfactorily for relatively shallow cutting depths and/or when cutting concrete of relatively high workability, as discussed hereinbelow.

Figure 10:
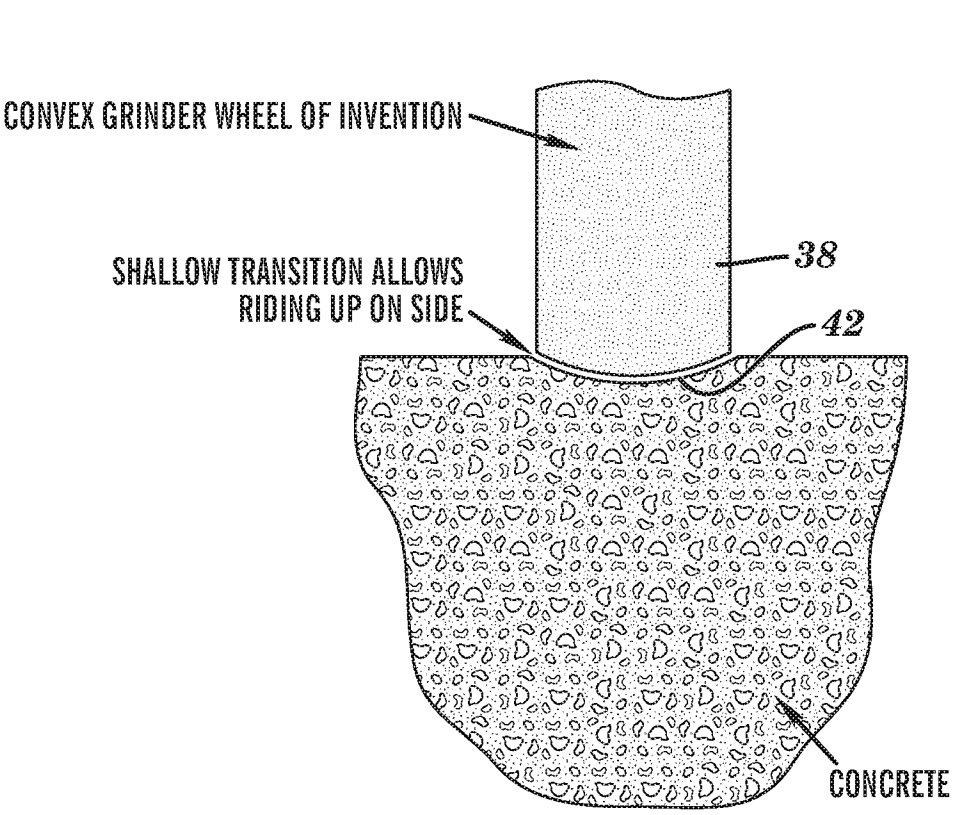
FIG. 10 is a view similar to that of FIG. 9 of the embodiment of FIGS. 1-7.

As best shown in FIGS. 9-11, the convex surfaces of the metallic segments 38 are configured to cut a relatively shallow, correspondingly shaped concave kerf 42 (FIG. 10) in a concrete ground surface. The concave geometry of the kerf 42 enables cutting wheel 26 to follow a non-linear path (FIG. 11), e.g., by steering the wheel 26 in the x-y plane as shown. Those skilled in the art will recognize that the convex/concave geometries of the cutting wheel 26/kerf 42 enable the wheel 26 to cut and/or effectively ride up the side of the kerf as necessary during the steering to avoid the binding that would otherwise occur when cutting with conventional cutting wheels of rectilinear cross-section as shown in FIG. 9. Moreover, as best shown in FIG. 8, the aforementioned placement of cutting wheel 26 between wheels 22 on substantially the same axis of rotation x at a front end portion of the frame 20, and the use of multi-directional wheels 24 at a rear end portion of the frame beneath handle 30, enables the user to steer the cutting wheel 26 by moving the rear end portion laterally, e.g., generally along the x-axis, so that the cutting wheel 26 stays at the center of rotation of the frame about the z-axis. Placing the cutting wheel 26 at the center of rotation in this manner helps minimize lateral forces on wheel 26 while turning.

It is also noted that the resulting concave shape of the kerf 42 may be sized and shaped to resemble the concave shape of a conventional grout or mortar line. This aspect enables the kerf to be colored and/or coated with a thin layer of grout or mortar once cutting is complete, as will be discussed in greater detail hereinbelow.

Turning back to FIGS. 1-5, in particular embodiments, frame 20 includes a ballast receptacle 60 configured to receive a plurality of ballast plates 62 therein to adjust weight of the apparatus, e.g., to provide enough weight to help ensure that cutting wheel 26 cuts at its desired depth. Those skilled in the art will recognize that many factors affect the workability of, the ability to cut, concrete. Some of these factors include: cement content; water content; mix proportions; size of aggregates; shape of aggregates; grading of aggregates; surface texture of aggregates; use of admixtures; and use of supplementary cementitious materials. Thus, concretes of relatively high workability may be cut with relatively low weight on receptacle 60, while a relatively high weight may be needed for less workable concrete.

Thus, the operator adjusts the total weight of the apparatus by adding or removing weights (ballast plates 62) to or from the receptacle 60. Adjusting the total weight in this manner helps ensure that the cutting wheel 26 penetrates the concrete surface to the desired depth, while being limited by a limit stop, according to different levels of workability (e.g., compressive strengths) of the various concrete mixes that are encountered, and while minimizing the weight that the operator has to push.

Figure 4:
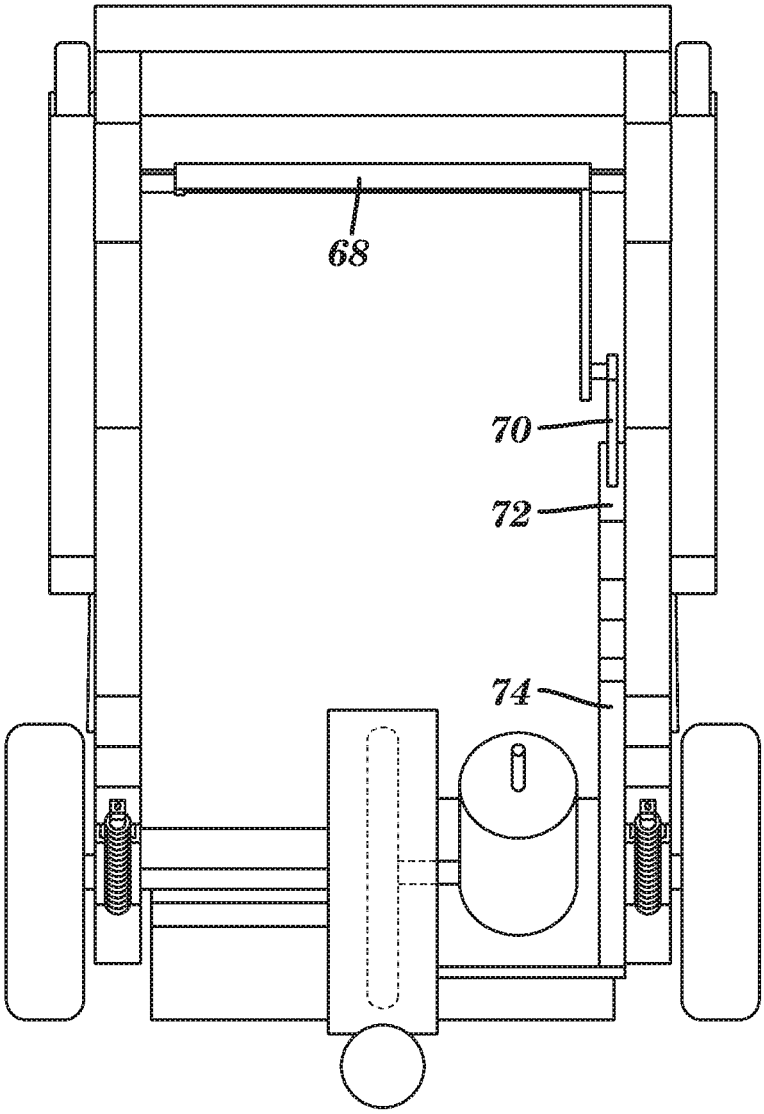
FIG. 4 is plan view of the embodiment of FIGS. 1-3.

In particular embodiments, the cutting wheel 26 is moveable to the desired depth by cutting depth adjuster 66 (FIG. 3) disposed on the frame, and which is configured to alternately move the cutting wheel towards and away from the concrete surface. In the embodiment shown, depth adjuster 66 includes a conventional deadman switch (actuator) 68 (FIG. 3) movable against a spring bias into contact with handle 30 where it may be held by a user during operation. As best shown in FIG. 4, actuator 68 is connected to a linkage 70, cam 72, and spring 74, which biases the cutting wheel 26 out of engagement with the concrete when the actuator 68 is released, while engagement of actuator 68 moves the cutting wheel 26 into engagement with the concrete. The adjustable limit stop prevents the grinding wheel from engaging too deeply into the concrete and thus creates a consistent cut depth. The depth adjuster 66 enables the operator to engage and disengage the grinder as the cut is started or stopped and the machine is moved elsewhere. As discussed, the spring biasing of the adjustor serves as a deadman switch to disengage the grinding wheel 26 from the concrete if the actuator 68 is released by the user. This enhances the safety of the operator and others in case of unforeseen events in which the operator accidentally releases the handle 30.

As best shown in FIG. 5, a dust collector 78, such as a conventional flexible vacuum hose, is communicably coupled to shroud 32 to capture concrete dust generated by the machine. An on/off switch (not shown) for the grinder 34 may be disposed at handle 30.

Referring now to Table I, a method 100 for restoring a concrete ground surface by forming portions resembling natural stone, pavers or flagstone is described.

TABLE I

| | |
|---|---|
| 102 | providing 102 the apparatus shown and described with respect to FIGS. 1-11 |
| 104 | engaging 104 the handle 30 and steering the apparatus to a desired location |
| 106 | Optionally marking the non-linear path |
| 108 | visually aligning the shroud and cutting wheel with the non-linear path |
| 109 | Optionally aligning along a clear line of sight from handle, through the frame, to the shroud |
| 110 | Actuating cutting wheel |
| 112 | Actuating depth adjuster 66 to engage cutting wheel with concrete surface |
| 114 | Guiding cutting wheel along the non-linear path |
| 116 | Once cutting is complete, releasing depth adjuster to lift the cutting wheel out of the kerf. |

The method 100 includes providing 102 the apparatus shown and described with respect to FIGS. 1-11, engaging 104 the handle 30 and steering the apparatus to a desired location on the concrete ground surface, i.e., to a point on a non-linear path on the concrete ground surface. The non-linear path may be optionally marked on the ground at 106, e.g., using chalk or the like, or may be created by the user extemporaneously while steering the apparatus.

While engaging the handle, the user visually aligns, at 108, the shroud 32 and cutting wheel 26, with the non-linear path. Optionally, the visually aligning 108 includes looking 109 along a clear line of sight s extending from handle 30 through the frame 20 to the shroud 32. The cutting wheel 26 is then actuated 110 with motor 34. At 112, the user engages actuator 68 of the depth adjuster 66 to engage the rotating cutting wheel 26 with the concrete ground surface to cut a kerf 42. At 114, the user walks behind and steers the apparatus to guide the cutting wheel along the non-linear path, so that the kerf extends along the non-linear path. The orientation of the grinding wheel between the fixed direction front wheels as well as the multi-directional rear wheels, keep the grinding wheel in the center of z-axis rotation. The convex shape of the grinding wheel allows for smooth turns along the cut path as the operator turns the machine left or right, without binding in the kerf, e.g., by effectively permitting the cutting wheel to ride up and/or into the side walls of the kerf while turning. Once cutting is complete, the operator releases the actuator 68 at 116 so that the spring bias of depth adjuster 66 lifts the cutting wheel 26 out of the kerf.

Referring now to Table II, additional option aspects of method 100 include placing one or more ballast plates 62 on a ballast receptacle 60 of the frame at 122, prior to said actuating depth adjuster 112. At 126, grout or mortar is optionally applied to the kerf, and at 128, color in the form of paint, stain and/or dye is applied to the concrete ground surface and/or to the grout or mortar. It should be recognized that the term 'concrete ground surface' refers to the concrete surface forming the 'ground' upon which users walk with the walk-behind apparatus 10. The application of color to the concrete ground surface at 128 may thus help make the portions of the concrete bordered by the kerfs resemble flag stones and the like. At 130, the color application 128 includes applying a base color substantially uniformly to the concrete ground surface including the grout or mortar, and then selectively applying a secondary color to portions, e.g., peaks, of the concrete surface texture, in an irregular and/or selective manner, to produce a color distribution resembling natural stone pavers and flagstones.

TABLE II

| | |
|---|---|
| 122 | Placing ballast plates on ballast receptacle |
| 126 | Applying grout or mortar to the kerf |
| 128 | Applying color to the concrete ground surface and/or to the grout or mortar |
| 130 | Applying a base color to the concrete ground surface, and selectively applying a secondary color to portions of the concrete surface texture in an irregular and/or selective manner |

The present invention has been described in particular detail with respect to various possible embodiments, and those of skill in the art will appreciate that the invention may be practiced in other embodiments. First, the particular naming of the components, capitalization of terms, the attributes, or any other structural aspect is not mandatory or significant, and the mechanisms that implement the invention or its features may have different names, formats, or protocols. Also, the particular division of functionality between the various system components described herein is merely exemplary, and not mandatory; functions performed by a single system component may instead be performed by multiple components, and functions performed by multiple components may instead performed by a single component.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims. It should be further understood that any of the features described with respect to one of the embodiments described herein may be similarly applied to any of the other embodiments described herein without departing from the scope of the present invention.

Having thus described the invention, what is claimed is:

1. A method for restoring a concrete ground surface by forming portions resembling natural stone, pavers or flagstone, the method comprising:

(a) providing a walk-behind apparatus for cutting non-linear trenches in concrete, the apparatus including:

a frame supported by at least three ground engaging wheels, the frame having:

one or more fixed direction wheels at a front end portion of the frame disposed to rotate on a fixed axis of rotation; and one or more multi-directional wheels at a rear end portion of the frame disposed to rotate on one or more movable axes of rotation;

wherein the at least three ground engaging wheels define an x-y plane and permit the frame to rotate about a z-axis passing through the frame normal to the x-y plane;

a user-engageable handle disposed at the rear end portion of the frame, the handle being engageable by a user walking behind the frame for pushing the apparatus forward and/or for steering the apparatus by pushing the handle left or right;

a motor-driven ground-engaging cutting wheel having a cutting wheel axis of rotation, a diameter D in a range of from about 5 inches to about 20 inches, with a cutting portion having a width w in a direction parallel to said cutting wheel axis of rotation within a range of from about 0.5 inches to about 1.5 inches;

the cutting wheel axis of rotation being substantially parallel to said fixed axis of rotation and extending notionally through said one or more fixed direction wheels;

the cutting wheel being disposed within a substantially disc-shaped protective shroud sized and shaped to contain a majority of the cutting wheel therein during said operation, the protective shroud disposed in view of the user while engaging the handle, to permit the user to visually align the shroud and cutting wheel with a non-linear path on the ground during said pushing and steering to guide the cutting wheel along the non-linear path;

(b) engaging the user-engageable handle to steer the apparatus to a desired location on the concrete ground surface;

(c) visually aligning, while engaging the handle, the shroud and cutting wheel with a non-linear path on the concrete ground surface;

(d) actuating the cutting wheel to rotate about the cutting wheel axis of rotation;

(e) engaging the cutting wheel with the concrete ground surface to cut a kerf;

(f) walking behind and steering the apparatus to guide the cutting wheel along the non-linear path, wherein the kerf extends along the non-linear path; and (g) filling the kerf with grout or mortar.

2. The method of claim 1, wherein said providing (a) further comprises the frame having a ballast receptacle configured to receive a plurality of ballast plates therein to adjust weight of the apparatus.

3. The method of claim 1, further comprising applying texture to the concrete ground surface.

4. The method of claim 1, wherein:

said providing (a) further comprises providing the cutting wheel in the form of a segmented grinding wheel having circumferentially spaced metallic segments, the segments each having a cutting surface of convex cross-section in a plane parallel to the cutting wheel axis of rotation, wherein said engaging (e) further comprises cutting a kerf of concave cross-section; and wherein said walking (f) further comprises permitting the grinding wheel to ride up and/or into side walls of the kerf during said steering to avoid binding.

5. The method of claim 1, wherein said providing (a) further comprise said one or more fixed direction wheels including a pair of fixed direction wheels at the front end portion of the frame, said pair of fixed direction wheels disposed to rotate on the fixed axis of rotation.

6. The method of claim 5, wherein said one or more multi-directional wheels comprises a pair of multi-directional wheels at the rear end of the frame.

7. The method of claim 5, wherein said cutting wheel is disposed between said pair of fixed direction wheels.

8. The method of claim 1, wherein said providing (a) further comprises the frame being open to provide the user engaging the handle with a clear line of sight through the frame to the shroud.

9. The method of claim 8, wherein the apparatus includes a motor configured to drive said cutting wheel.

10. The method of claim 9, wherein the motor is disposed in spaced relation from said cutting wheel along said cutting wheel axis to provide the user engaging the handle with a clear line of sight to the shroud.

11. The method of claim 10, wherein the motor and cutting wheel comprise a unitary handheld grinder removably secured to said frame.

12. The method of claim 1, wherein said providing (a) further comprises the apparatus having a cutting depth adjuster configured to alternately move the cutting wheel towards and away from the x-y plane.

13. The method of claim 12, wherein said providing (a) further comprises the apparatus having a depth actuator disposed on said handle, said depth actuator communicably coupled to said cutting depth adjuster for adjusting the cutting depth. further comprise the frame being foldable to facilitate storage.

14. The method of claim 13, wherein said depth actuator comprises a deadman switch configured to withdraw the cutting blade from the kerf upon release of the handle.

15. The method of claim 13, wherein said providing (a) further comprises the apparatus having a dust collector communicably coupled to the shroud.

16. The method of claim 15, wherein the dust collector comprises a vacuum device communicably coupled to the shroud via a flexible conduit.

17. The method of claim 1, wherein said providing (a) further comprises the frame being foldable to facilitate storage.

18. The method of claim 17, wherein the frame includes articulating members configured to alternately move the rear end portion away from the front end portion into an operational position, and toward the front end portion into a closed, storage position.

19. The method of claim 1, wherein said providing (a) further comprise said cutting wheel being a segmented grinding wheel having circumferentially spaced metallic segments, the segments each having a cutting surface of convex cross-section in a plane parallel to the cutting wheel axis of rotation, wherein during operation, the metallic segments are configured to cut a kerf in a concrete ground surface while said convex cross-section permits the cutting wheel to ride up and/or into side walls of the kerf during said steering to avoid binding.

20. The method of claim 19, wherein said cutting wheel has a diameter D in a range of from about 6 inches to about 8 inches, and said width w is within a range of from about 0.75 inches to about 1.25 inches.

21. The method of claim 1, wherein said visually aligning (c) comprises looking along a clear line of sight through the frame to the shroud.

22. The method of claim 21, wherein said actuating (d) further comprises actuating a motor to drive said cutting wheel.

23. The method of claim 1, further comprising disposing one or more ballast plates on a ballast receptacle of the frame to adjust the weight of the apparatus, wherein the weight of the apparatus is adjusted based on composition of the concrete ground surface.

24. The method of claim 23, further comprising actuating a depth actuator disposed on the handle to adjust the cutting depth of the cutting wheel.

25. The method of claim 1, further comprising applying color in the form of paint, stain and/or dye to the concrete ground surface and/or to the grout or mortar.

26. The method of claim 25, further comprising applying a base color substantially uniformly to the concrete ground surface including the grout or mortar, and then selectively applying a secondary color to portions of the concrete ground surface to produce a color distribution, wherein the color distribution resembles natural stone pavers and flagstones.

* * * * *